US005160349A

United States Patent [19]

Cardis et al.

[11] Patent Number: 5,160,349

[45] Date of Patent: Nov. 3, 1992

[54] OLEFIN/MALEIC ANHYDRIDE COPOLYMER HETEROCYCLIC-AZOLES AS ANTIWEAR ADDITIVES, AND FUEL COMPOSITIONS

[75] Inventors: Angeline B. Cardis, Florence; Carl E. Shanholtz, Lawrenceville, both of N.J.

[73] Assignee: Mobil Oil Corporation, Fairfax, Va.

[21] Appl. No.: 438,835

[22] Filed: Nov. 20, 1989

[51] Int. Cl.[5] ..... C10L 1/22; C10L 1/18

[52] U.S. Cl. ..... 44/331; 44/342; 44/343; 44/346

[58] Field of Search ..... 44/51, 63, 342, 343, 44/351, 331

[56] References Cited

U.S. PATENT DOCUMENTS

| | | | |
|---|---|---|---|
| 3,677,725 | 7/1972 | Andiess | 44/62 |
| 4,060,491 | 11/1977 | Bridger et al. | 252/50 |
| 4,212,754 | 7/1980 | Chibnik | 252/49.7 |
| 4,263,015 | 4/1981 | Sung | 252/51.5 A |
| 4,282,007 | 8/1981 | Sung | 44/63 |
| 4,282,008 | 8/1981 | Sung | 44/63 |
| 4,416,668 | 11/1983 | Thompson | 44/63 |
| 4,445,907 | 5/1984 | Sung | 44/63 |
| 4,496,368 | 1/1985 | Kaufman | 44/63 |
| 4,519,928 | 5/1985 | Braid | 252/50 |
| 4,795,479 | 1/1989 | Karol | 44/63 |
| 4,800,028 | 1/1989 | Toukan | 252/25 |
| 4,810,261 | 3/1989 | Sung | 44/62 |
| 4,865,622 | 9/1989 | Sung | 44/62 |

*Primary Examiner*—Margaret Medley
*Attorney, Agent, or Firm*—Alexander J. McKillop; Charles J. Speciale; Jessica M. Sinnott

[57] ABSTRACT

A fuel composition contains an antiwear additive comprising the reaction product of heterocyclic compound having antiwear activity such as a triazole e.g. benzotriazole, tolyltriazole, and a copolymer with succinic anhydride moiety, such as an olefin/maleic anhydride copolymer.

6 Claims, No Drawings

OLEFIN/MALEIC ANHYDRIDE COPOLYMER HETEROCYCLIC-AZOLES AS ANTIWEAR ADDITIVES, AND FUEL COMPOSITIONS

FIELD OF THE INVENTION

The present invention relates to improved fuel compositions. More particularly, it is concerned with fuel compositions having improved wear resistance.

BACKGROUND OF THE INVENTION

Engines, namely reciprocating internal combustion engines and jet engines, are susceptible to wear in areas where contacting metal surfaces have little or no lubrication such as the fuel pump. Illustratively, with some fuel systems, friction surfaces of the fuel pump which are in contact with fuel are susceptible to wear. The fuel that is in contact with these friction surfaces can influence wear.

Various heterocyclic compounds reacted with certain anhydrides have been described. For example, U.S. Pat. No. 4,263,015 to Sung discloses motor fuel and lubricant compositions containing a reaction product of a hydrocarbyl succinic anhydride and an aminotriazole as a rust inhibitor.

SUMMARY OF THE INVENTION

It has now been found that fuel compositions containing the reaction products of heterocyclic compounds and copolymers containing anhydride moieties exhibit desirable antiwear characteristics.

DETAILED DESCRIPTION OF THE INVENTION

The fuel compositions of the present invention contain a reaction product of a copolymer containing an anhydride moiety and a heterocyclic compound. The copolymer reactant is formed by free radical co-polymerization of maleic anhydride and monomers to form the copolymers containing succinic anhydride moieties.

The monomers which may be copolymerized with the maleic anhydride include ethylenically unsaturated monomers, especially olefins of up to 18 carbon atoms, particularly alpha-olefins such as 1-hexene, 1-octene, 1-decene, 1-dodecene, 1-tetradecene, 1-hexadecene or 1-octadecene. Other unsaturated comonomers may also be used such as vinylic compounds e.g., vinyl acetate, acrylates and methacrylates e.g., methyl methacrylate.

Any convenient method of free radical copolymerization known in the art may be used and the use of polymerization catalysts such as benzoyl peroxide, peracetic acid, and the like may be desirable. It is preferred that the polymerization reaction not proceed beyond the point of solubility of the copolymer in the fuel in order to impart the solubility benefits of the copolymer to the heterocyclic compound. The degree of polymerization can be from 500 to 10,000 molecular weight. The preferred degree of polymerization ranges from 750 to 3,000 molecular wt. The resulting copolymer may contain 10 to 90 mole percent anhydride. The preferred range is 30 to 70 mole percent anhydride.

The polymer reactant produced by reaction of maleic anhydride with an olefin is represented by the formula:

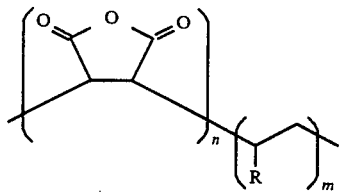

in which R is an aliphatic hydrocarbon radical having from 6 to 24 carbon atoms, m and n are integers. The hydrocarbon radical can be straight chain or branched and can be saturated or unsaturated. The preferred reactants have from 10 to 18 carbon atoms.

The heterocyclic compounds which may be used to react with the copolymers of maleic anhydride include any heterocyclic compound known in the art to be an effective antiwear agent. The preferred heterocyclic compounds include alkyl or aromatic substituted mono-, di- or triazoles; that is, a 5-membered ring structure in which one or more of the ring members is nitrogen, the other ring members being oxygen, sulfur or carbon, and having straight chain or branched alkyl, aryl, alkylaryl, or arylalkyl substituents containing from 0 to 30 carbons and from 0 to 6 carbon-carbon double bonds. Examples of suitable heterocyclic compounds include: imidazole, benzotriazoles, mercaptothiadiazoles, aminomercaptothiadiazoles, mercaptobenzothiazoles, and tolyltriazole.

The reactants can be combined at ambient pressure and at elevated temperature typically ranging from 10° C. to 300° C., the preferred range is from 20° to 270° C. In general, the reactants are contacted for about 0.50 to about 12 hours with from about 2 to about 6 hours being preferred; the particular reaction times depend on the temperature and the reactants. At higher temperatures, the reaction time may be shorter than the time at lower temperature for a given pair of reactants. A diluent or solvent may be used, normally an aromatic hydrocarbon solvent which is inert to the reactants and to the reaction product. A broad range of inert organic solvents are suitable for this purpose. The preferred solvent being a commercial mixture of xylenes.

The reaction may be run until substantial completion but, preferably, until such time as infrared spectroscopy indicates that the anhydride moiety has been reacted.

The reactants combine in stoichiometric proportions to form the reaction product although the reaction may be carried out in a molar ratio of anhydride to heterocyclic compound of 3:1 to 1:1.

A minor amount of the reaction product is blended with a major amount of the fuel; any amount of the reaction product which is effective to impart the desired degree of wear reduction to the fuel may be used. The additive is effective in amounts from 0.005 to 5.0% and preferably from 0.05 to 0.3% of the total weight of the composition.

The fuels that may be used for the purposes of this invention include liquid hydrocarbon fuel, such as diesel oil, fuel oil and gasoline. The specific hydrocarbon fractions contemplated include distillate fuels which boil in the kerosene and gas oil range, usually about 330° to 1050° F. (165° to 565° C.). Typical middle distillate fuels of this kind include road diesel fuels and other diesel fuels which boil in the range of about 400° to 700° F. (about 205° to 370° C.). Other fuels that may be used include oxygenated fuels such as alcohol fuels, i.e.

methanol and ethanol, ethers and mixtures thereof. A blend of hydrocarbon fuels and oxygenated fuels may also be used.

It is probable that these reaction products display other desirable characteristics such as antioxidation and metal passivation. Such properties depend upon and vary with the specific heterocyclic compound used.

An important characteristic of the present invention is that the reaction imparts high solubility to the heterocyclic compound in fuels. Various heterocyclic compounds known in the art to be effective antiwear agents such as benzotriazoles suffer from low solubility in fuels. The reaction product of the present application has high solubility in fuels. It is believed that the anhydride moiety in the fuel soluble copolymer provides a convenient reaction site for the heterocyclic compound and, thus, increases the solubility of the heterocyclic compound in fuels without sacrificing the antiwear properties of the heterocyclic compound.

Other additives may be useful in formulating the fuel composition of the present invention. These compositions include anticorrosion agents, antioxidants, demulsifying agents and the like.

The following examples illustrate the preparation of the reaction product which is blended with a fuel oil to make the fuel composition of the present invention.

EXAMPLE 1

25.0 gm of a 50:50 octadecene/maleic anhydride copolymer, 5.0 gm of imidazole, and 50.0 mL of xylenes were charged to a 250 mL reactor equipped with a $N_2$ inlet, mechanical stirrer, thermometer, and condenser. The mixture was heated to reflux under a $N_2$ purge. After 4 hours, no anhydride was evident by infrared spectroscopy. The solvent was evaporatively distilled. The remaining oil was dried in a vacuum oven at 250–300 mm Hg and 100° C. for 16 hours.

EXAMPLE 2

25.0 gm of a 50:50 octadecene/maleic anhydride copolymer, 9.0 gm of tolyltriazole and 50.0 mL of xylenes were charged to a 250 mL reactor equipped with a $N_2$ inlet, mechanical stirrer, thermometer, and condenser. The mixture was heated to reflux at 145° C. under a $N_2$ purge. After 4 hours, 40 mL of solvent was removed and the temperature of the reaction was elevated to 250° C. After 3 hours, no anhydride was evident by infrared spectroscopy. The mixture was dried in a vacuum oven at 250–300 mm Hg and 100° C. for 16 hours.

The following data illustrate the improved antiwear characteristics of the present invention. The antiwear properties of the fuel composition were determined in the 4-Ball Wear Test. This test was conducted in a device comprising four steel balls, three of which were in contact with each other in one plane in a fixed triangular position in a reservoir containing the test sample. The fourth ball was above and in contact with the other three. The fourth ball was rotated while it was pressed against the other three balls. The pressure was applied by weight and lever arms. The diameter of the scar on the three lower balls was measured by means of a low power microscope. The average diameter was measured in two directions on each of the three lower balls and was then taken as a measure of the antiwear characteristics of the fuel. In the antiwear test data reported below in Table 1, the base stock fuel comprised a diesel fuel containing 0.19 wt % of sulfur and 0.1% of the reaction product. The lower the wear diameter, the more effective the composition as an antiwear agent.

The balls were immersed in base fuel containing the test additives. Applied load was 10 kg and rotation was at 600 rpm for 30 minutes at 122° C. Tests were conducted with both base fuel alone and base fuel containing the reaction products.

TABLE I

Four Ball Wear Test Results On Fuel Composition Containing Reaction Product

| Additive in Base Stock (0.1 wt%) | Wear Scar Diameter (mm) |
|---|---|
| None | 0.525 |
| Example 1 | 0.396 |
| Example 2 | 0.290 |

We claim:

1. A fuel composition having antiwear properties comprising a liquid hydrocarbon fuel, a liquid oxygenated fuel or a blend of the liquid hydrocarbon fuel and the liquid oxygenated fuel and from 0.005 to 5 wt. % of a reaction product of a heterocyclic azole compound selected from the group consisting of benzotriazole, imidazole, or tolytriazole and a 1-olefinic copolymer containing 30 to 70 mole % of a maleic anhydride moiety wherein the 1-olefin contains between 6 and 18 carbon atoms.

2. The composition of claims 1 wherein the 1-olefin is 1-octadecene.

3. The composition of claim 1 wherein the fuel is a diesel fuel.

4. The composition of claim 1 wherein the oxygenated fuel is an alcohol or an ether or a blend of the alcohol and the ether.

5. An additive composition for blending with hydrocarbon fuels, oxygenated fuels or mixtures thereof to produce a fuel composition having antiwear properties, the additive composition is blended in amounts ranging from 0.005 to 5.0% of the total fuel composition, the additive composition comprising a reaction product of a heterocyclic azole compound selected from the group consisting of benzotriazole, imidazole or tolyltriazole and a 1-olefinic copolymer containing about 30 to 70 mole % of a maleic anhydride moiety wherein the 1-olefin contains between 6 and 18 carbon atoms.

6. The composition of claim 5 wherein the 1-olefin is 1-octadecene.

* * * * *